US006380833B1

(12) United States Patent
Nguyen et al.

(10) Patent No.: US 6,380,833 B1
(45) Date of Patent: Apr. 30, 2002

(54) ENCAPSULATED MAGNET ASSEMBLY AND METHOD FOR MAKING THE SAME

(75) Inventors: Hy Ba Nguyen, Upland; Mario Fregoso, Whittier; Thomas J. Sievers, Upland, all of CA (US)

(73) Assignee: Saint-Gobain Performance Plastics Corporation, Wayne, NJ (US)

( * ) Notice: Subject to any disclaimer, the term of this patent is extended or adjusted under 35 U.S.C. 154(b) by 0 days.

(21) Appl. No.: 09/287,717

(22) Filed: Apr. 7, 1999

(51) Int. Cl.[7] ..... H01F 7/00
(52) U.S. Cl. ..... 335/301; 336/90; 336/96
(58) Field of Search ..... 332/302–306, 332/420; 417/423.2; 310/90, 103–4, 110; 29/598, 607; 336/90, 96

(56) References Cited

U.S. PATENT DOCUMENTS

| | | | | | |
|---|---|---|---|---|---|
| 2,560,926 | A | | 7/1951 | Brownell | 175/356 |
| 3,354,541 | A | | 11/1967 | Gosma | 29/607 |
| 3,591,818 | A | * | 7/1971 | Fulton | 310/90 |
| 3,656,231 | A | | 4/1972 | Sheldon et al. | 29/624 |
| 3,808,569 | A | | 4/1974 | Sheldon et al. | 335/210 |
| 4,303,062 | A | | 12/1981 | Vars | 128/1.3 |
| 4,414,523 | A | * | 11/1983 | Pieters | 335/202 |
| 4,574,261 | A | | 3/1986 | Cochran | 335/299 |
| 4,647,891 | A | | 3/1987 | Hughes | 335/302 |
| 4,746,889 | A | | 5/1988 | Rivoir | 335/296 |
| 4,810,987 | A | | 3/1989 | Liebthal et al. | 335/302 |
| 4,998,082 | A | | 3/1991 | Duimstra | 335/154 |
| 5,226,220 | A | * | 7/1993 | Gaves et al. | 336/96 |
| 5,691,681 | A | * | 11/1997 | Okugawa | 335/284 |
| 5,763,973 | A | * | 6/1998 | Cramer | 310/103 |
| 5,964,028 | A | * | 10/1999 | Buse | 29/598 |
| 5,993,176 | A | * | 11/1999 | Kingsford et al. | 417/420 |
| 6,007,312 | A | * | 12/1999 | Pieters | 417/420 |
| 6,118,361 | A | * | 9/2000 | Ogawa | 336/96 |

* cited by examiner

*Primary Examiner*—Lincoln Donovan
*Assistant Examiner*—Tuyen T. Nguyen
(74) *Attorney, Agent, or Firm*—Christie, Parker & Hale, LLP

(57) ABSTRACT

An encapsulated magnet assembly comprises a non-metallic housing and a magnet disposed within a housing magnet chamber. A housing end cap is fuse bonded to the housing to encapsulate the magnet therein and form an air and fluid-tight seal with the housing. An insulating spacer is interposed between an exposed surface of the magnet and the end cap before assembly and fuse bonding, and is formed from a thermally insulating material to prevent the transmission of thermal energy to the magnet during the fuse bonding process. The insulating spacer serves to protect the magnet from unwanted thermally induced magnetic field losses. The housing also includes one or more projections that extend into the magnet chamber and that cooperate with complementary grooves in the magnet to prevent the magnet from rotating within the chamber.

17 Claims, 4 Drawing Sheets

ENCAPSULATED MAGNET ASSEMBLY AND METHOD FOR MAKING THE SAME

FIELD OF THE INVENTION

This invention relates to a magnet assembly in the form of a magnet encapsulated within a non-metallic containment body and, more particularly, to an encapsulated magnet assembly constructed to eliminate heat induced magnetic losses that are known to occur during the process of making the magnet assembly.

BACKGROUND OF THE INVENTION

Encapsulated magnet constructions known in the art comprise a magnet disposed within a non-metallic containment body. Encapsulated magnet constructions of this type can be used in magnetically-driven applications such as pumps and the like, where it is essential that the metal magnet remain isolated from the displaced or pressurized liquid. An example application for use of an encapsulated magnet construction is in centrifugal pumps, where the encapsulated magnet construction is connected to or is in the form of a pump impeller that is placed in contact with the process liquid. The encapsulated magnet/impeller is driven, i.e., rotated, by a rotating magnet that is isolated from the process liquid. The encapsulated magnet is configured such that one of its magnetic poles are uniformly oriented toward the opposite poles of the rotating magnet. In this manner, a magnetic force or field is developed between the magnets that locks or couples the magnets together so that the encapsulated magnet impeller rotates around the rotating magnet, causing the encapsulated magnet to pressurize the process fluid.

Encapsulated magnet assemblies known in the art are typically formed by inserting a magnet into a non-metallic magnet containment body and then fusion welding a non-metallic cap to the body to encapsulate the magnet therein. Other known encapsulated magnet constructions are formed by in-situ encapsulation, whereby the metallic magnet body is surrounded by a non-metallic material by injection mold process. The in-situ encapsulation process enables magnet encapsulation in a single step without having to perform a multi-step encapsulation operation of inserting the magnet into a containment body and then welding a cap to the containment body to achieve encapsulation.

A common feature of each of the above-described encapsulated magnet constructions is that they are formed by subjecting the magnet to heat, either during the step of welding the cap to the containment body or during in-situ encapsulation by injection molding. Encapsulated magnet constructions formed in this manner are known to suffer magnetic field losses during the fabrication process due to their unprotected exposure to this heat. Accordingly, encapsulated magnet constructions produced in this manner are known to display magnetic field losses that may render them unuseful, either initially or after a period of time, to perform as intended in a particular magnetically-driven application, e.g., to drive a magnetically-coupled pump or the like.

Additionally, while such known encapsulated magnet constructions do provide a structure that isolates or shields the metallic magnet component from the outside environment, be it gas or liquid, they fail to provide a structure that prevents the magnet from moving internally within the containment body, e.g., from becoming decoupled from and rotating within the containment body during operation within a given device. For this reason, such conventional encapsulated magnet constructions are known to have a reduced service life due to either an initial or eventual decoupling of the magnet from the containment body. When used in the application of a magnetically-coupled pump, such initial or eventual magnet decoupling, while not causing the magnet to become exposed to the process liquid, will reduce pump efficiency and the ability of the pump to produce a desired output pressure.

It is, therefore, desired that an encapsulated magnet assembly be constructed in such a manner as to reduce or eliminate magnetic losses otherwise known to occur during the fabrication process, thereby providing an encapsulated magnet construction having magnetic properties that is approximately that of the preinstalled magnet itself. It is also desired that such encapsulated magnet assembly be constructed to prevent the magnet from becoming decoupled from the containment body, to thereby ensure a long and predictable service life when used in magnetically-driven applications.

SUMMARY OF THE INVENTION

The present invention comprises an encapsulated magnet assembly and method of making the same that minimizes or eliminates altogether thermally-induced magnetic field losses known to occur in conventional encapsulated magnet assembly devices, and that also prevents the magnet from becoming decoupled from its encapsulating housing during use. Encapsulated magnet assemblies of this invention comprise a magnet containment housing that is formed from a non-metallic material having an magnet chamber disposed therein for accommodating a magnet. A magnet is disposed within the magnet chamber and an end cap formed from a non-metallic material is attached to an end of the housing to sealably encapsulate the magnet therein. A thermally-insulating spacer is interposed between the magnet and the cap before attachment of the cap to the housing, and serves to minimize or prevent altogether unwanted transfer of thermal energy to the magnet during the process of sealing the end cap to the housing. The housing additionally includes means for maintaining the rotational position of the magnet within the housing magnet chamber fixed during operation of the encapsulated magnet assembly in a device such as a centrifugal pump

DESCRIPTION OF THE DRAWINGS

These and other features and advantages of the present invention will be appreciated as the same becomes better understood by reference to the following detailed description when considered in connection with the accompanying drawings wherein:

FIG. 3 illustrates a bottom cross-sectional view of the encapsulated magnet assembly of FIG. 1; and.

DETAILED DESCRIPTION OF THE INVENTION

Encapsulated magnet assemblies, constructed in accordance with this invention, generally comprise a magnet that is disposed within a non-metallic housing, and an end cap that is attached over an opening of the housing to encapsulate the magnet therein. A spacer formed from thermally-insulating material is interposed between the magnet and the end cap to minimize/eliminate the amount of thermal energy that is transferred to the magnet during the process of heat welding the cap to the housing. The assembly also comprises means for preventing the magnet from rotating or moving internally within the housing during operation of the assembly.

Figure 1:
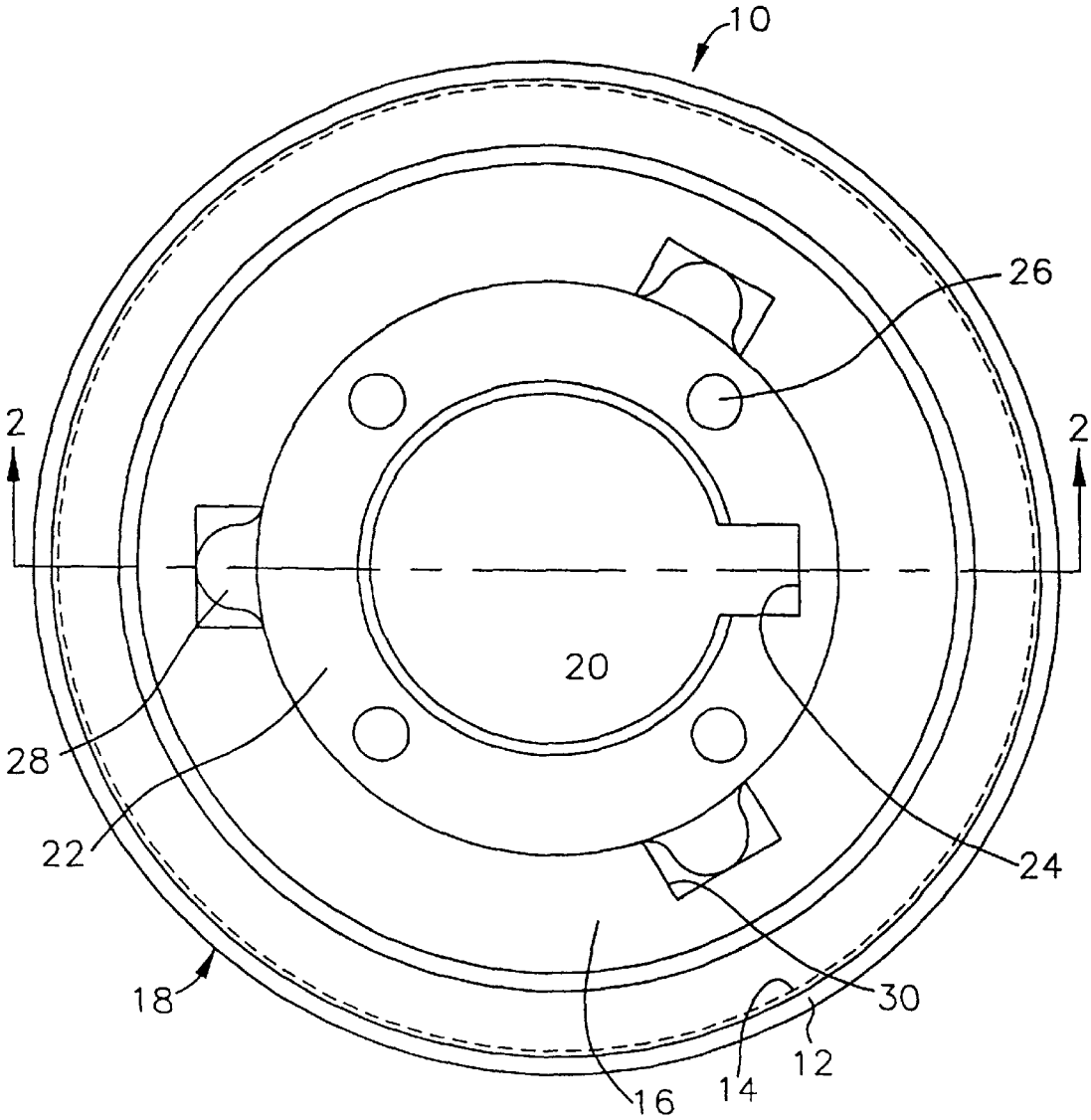
FIG. 1 illustrates a top plan view of a partially-assembled encapsulated magnet assembly constructed according to principles of this invention.

FIG. 1 illustrates an example embodiment of a partially-assembled encapsulated magnet assembly 10, as constructed according to principles of this invention, comprising a housing 12 having an internal chamber 14 disposed therein for accommodating a magnet 16. In the example embodiment illustrated, the housing is in the form of a ring having an outside diameter 18 and an inside diameter 20 that are each defined by concentric housing walls. The inside and outside diameters are joined together by a base (see 32 in FIG. 2) that extends radially between the diameters and defines a bottom portion of the housing. The chamber 14 is annular and resides between inside wall surfaces of the inner and outer housing walls. The example embodiment is configured to accommodate a ring-shaped magnet 16 within the annular chamber 14 for use as a rotating magnet assembly in such applications as a centrifugal pump pressurizing member, e.g., impeller, and the like.

As discussed above, the housing inside diameter 20 is defined by an inside wall surface, which is part of an inside diameter structure 22 that extends radially outwardly into the magnet chamber a determined distance. The inside diameter structure 22 can be configured in a variety of shapes or having a number of different structures to facilitate attaching the assembly 10 to another member for use in a particular application. For example, the inside diameter structure can be configured having a groove 24 disposed axially along the inside wall surface engage a complementary tongue (not shown) of a shaft or the like that is disposed within the assembly inside diameter to enable use of the assembly in a particular application. As illustrated, the inside diameter structure 22 can also include a number of openings 26 that pass axially therethrough to facilitate attachment of the assembly to another member to facilitate its use in a particular application.

The housing also includes means for preventing the magnet from rotating internally within the magnet chamber. In an example embodiment, such means is in the form of one or more projections 28 that extend radially a distance away from the inside diameter structure into the magnet chamber 14. In a preferred embodiment, the inside diameter structure comprises three such projections 28 that are positioned at 120 degree intervals from one another. The magnet 16 that is placed within the chamber includes one or more groove 30 disposed axially along a magnet inside diameter surface that is sized to accept placement of a respective projection 28. In a preferred embodiment, the magnet includes three such grooves 30 that are positioned at 120 degree intervals to accommodate placement of respective projections therein. Together, the cooperation of the projection(s) and groove(s) fix the magnet within the chamber to prevent rotational magnet movement or decoupling within the housing during operation of the assembly in a particular assembly application.

Figure 2:
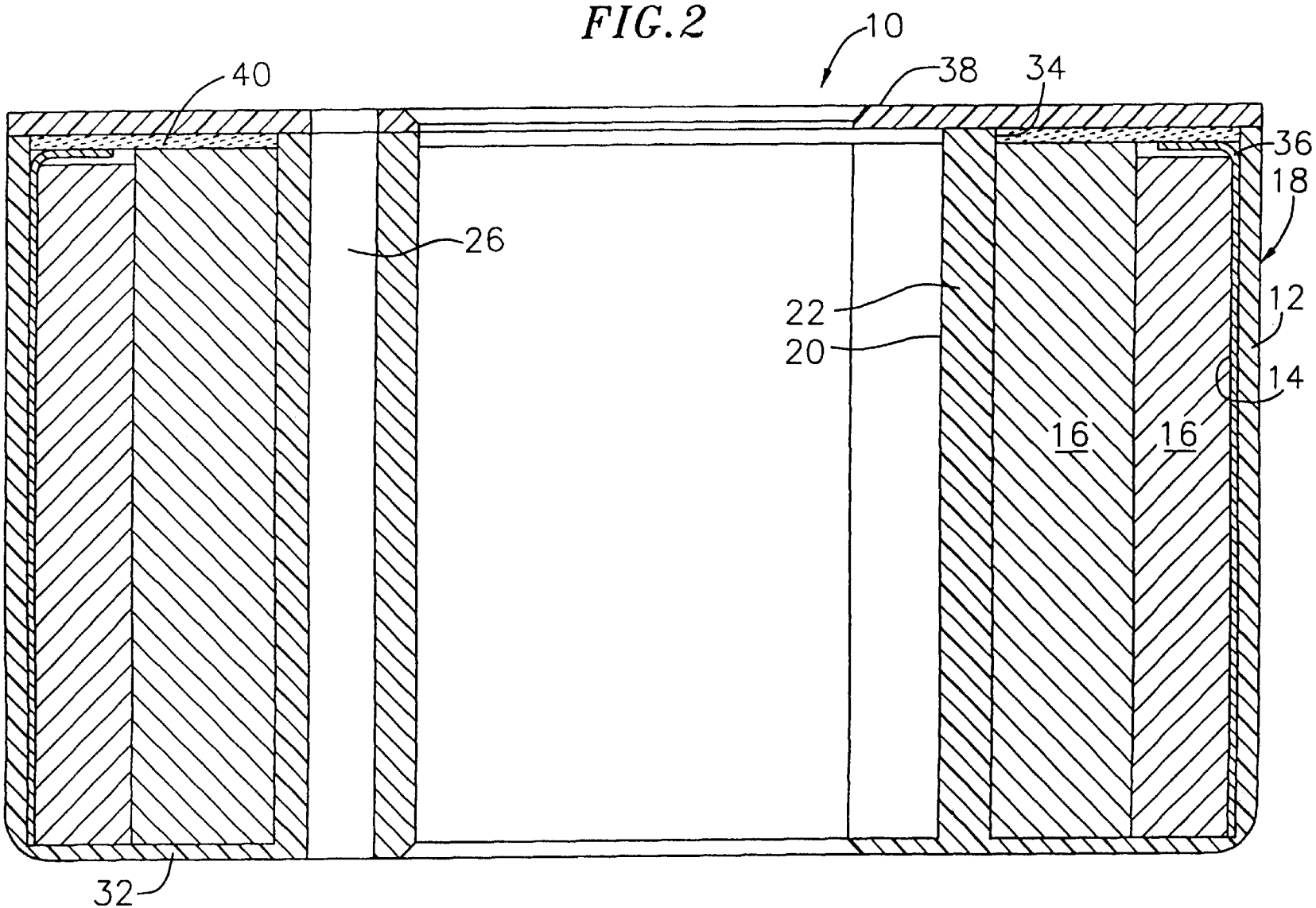
FIG. 2 illustrates a transverse cross-section of a completely assembled encapsulated magnet assembly of FIG. 1 across section 2—2.

The encapsulated magnet assembly 10 illustrated in FIG. 1 is partially assembled in that the magnet 14 remains exposed within the chamber 14 along a top axial surface between the housing inside and outside diameters surfaces 20 and 18. FIG. 2 illustrates the encapsulated magnet assembly 10 of FIG. 1 in its fully-assembled configuration. The magnet 16 is disposed within the annular chamber 14 such that it extends axially therein from a housing base 32, located at a bottom of the magnet chamber, to an annular opening 34 that extends radially across the chamber between the housing inside and outside diameter walls 20 and 18. In an example embodiment, the magnet 16 comprises two concentric members that are each configured such having magnetic poles oriented in a particular direction, e.g., the magnet inner member can be oriented with its south poles directed radially inwardly, and the outer member can be oriented with its south poles directed radially outwardly to take advantage of desired magnetic coupling effects with another magnetic member used in a particular magnetic assembly application. In such an embodiment, the two concentric magnet members are held together by a retaining member 36, e.g., disposed around an outside surface of the outer magnet member.

A housing end cap 38 is disposed over the annular magnet chamber opening 34 and is permanently attached thereto to encapsulate the magnet therein, to provide a fluid and air-tight seal with the housing. The assembly housing 12 and end cap 38 are preferably formed from the same non-metallic material. For applications where the assembly is placed into contact with a liquid that is a corrosive and/or high purity process chemical, it is important that the housing be chemically resistant so that it will not degrade upon contact with the process chemicals and introduce unwanted contamination into an otherwise pure chemical processing operation. The introduction of such contaminants can be due to the degradation of the material itself or can be due to contact of the metal magnet with the process liquid, in either case such unwanted contamination could potentially cause hundreds of thousands of dollars of damage to an end product, e.g., a semiconductor, manufactured using such process liquids.

In such application, it is desired that the housing and end cap be constructed from a fluoropolymer compound selected from the group of fluoropolymers including but not limited to polytetrafluoroethylene (PTFE), fluorinated ethylene-propylene (FEP), perfluoroalkoxy fluorocarbon resin (PFA), polychlorotrifluoroethylene (PCTFE), ethylene-chlorotrifluoroethylene copolymer (ECTFE), ethylene-tetrafluoroethylene copolymer (ETFE), polyvinylidene fluoride (PVDF), polyvinyl fluoride (PVF) and the like. A particularly preferred material is Teflon® PFA or Teflon® PTFE, which are provided by DuPont Company of Wilmington, Del. Such materials are not damaged by corrosive, acidic, or caustic liquids, and do not introduce contamination into chemically pure liquids. In a preferred embodiment, the assembly housing 12 is formed from a modified fluoropolymer which has properties similar to PFA and PTFE. The end cap 38 is formed from PFA. The housing and cap can either be formed by machine or mold process. In a preferred embodiment, both members are formed by mold process.

The housing 12 and end cap 38 are fused bonded together using conventional fuse bonding methods. A protective spacer or shield 40 is interposed between the exposed axial surface of the magnet 16 and the end cap 38. In the illustrated example embodiment, e.g., one comprising a ring-shaped housing and magnet disposed within an annular chamber, the spacer 40 is in the form of a ring-shaped disk. The spacer 40 is formed from a thermally insulating material and is used to protect the magnet from the unwanted transmission of thermal energy during the process of fuse bonding the cap to the housing, thereby minimizing or eliminating altogether the possibility of thermally-induced magnetic losses.

Suitable materials useful for forming the protective spacer include those materials that have low properties of thermal conductivity, such as ceramic materials, polymers, and the like. A preferred insulating material is mica or other silicate-based ceramic. It is desired that the protective spacer be formed from a material, and be sized having a determined thickness, to minimize or prevent the heat from being transferred from the weld point, between the end cap and the housing, to the magnet. In the example embodiment, a preferred protective spacer is one made from mica having a thickness in the range of from about 0.2 millimeters (mm) to 2 mm. It is to be understood that the desired spacer thickness is a function of the material that is used to form the spacer, and can increase or decrease depending on whether the material displays less or more thermal conductivity. If a mica spacer is used having a thickness outside of this range, the spacer will either be thicker than is required to provide a desired degree of thermal insulation, thus being economically inefficient, or will be too thin to provide the desired degree of thermal insulation.

Figure 3:
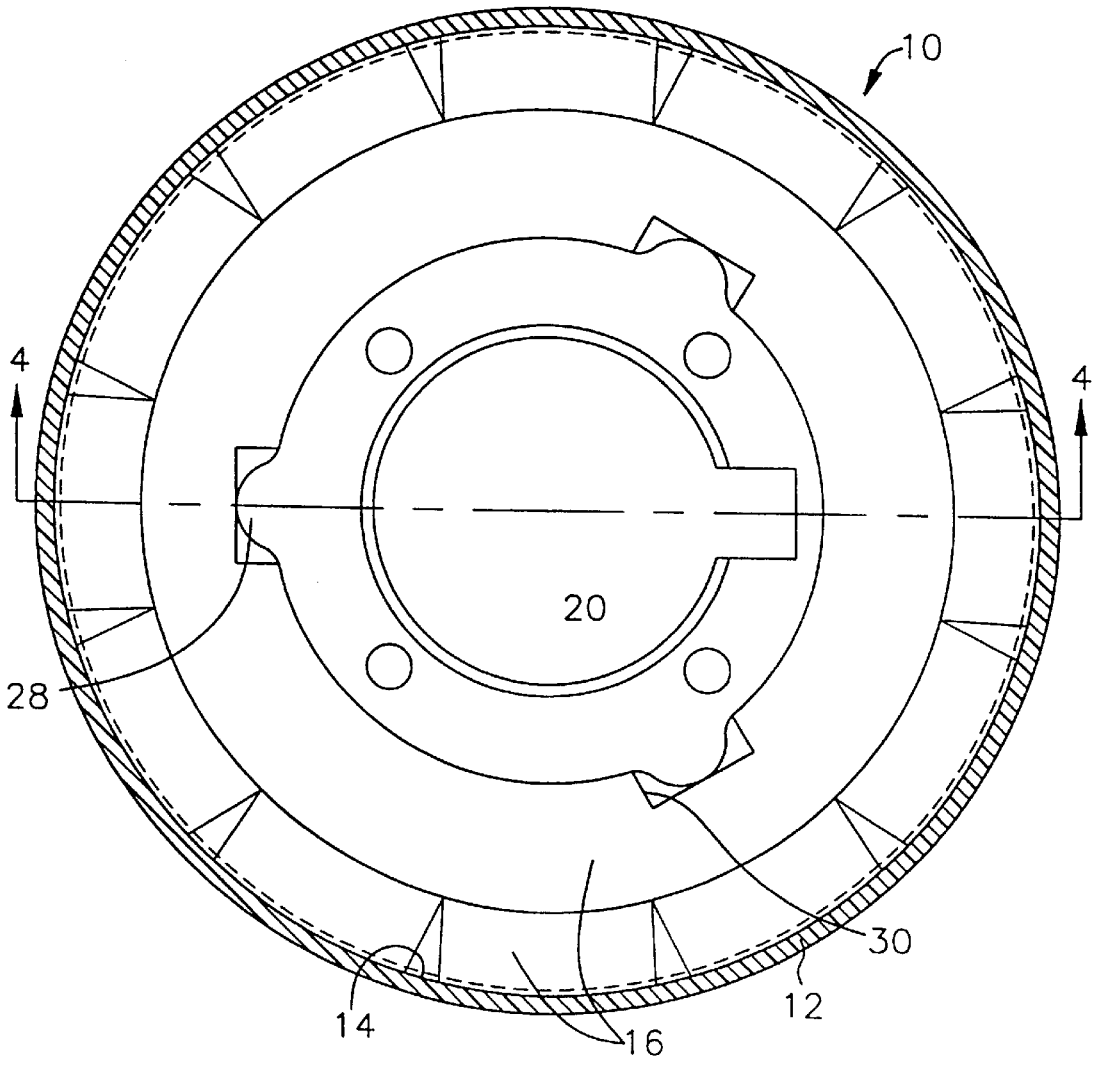

FIG. 3 illustrates a bottom cross-sectional view of the encapsulated battery assembly 10. The magnet 16 is shown disposed within the battery chamber 14, and fixed rotatably therein by cooperation of the inside structure projections 28 with respective battery grooves 30. The outer diameter magnet member is illustrated comprising a number of individual magnets arranged around the inner magnet member, wherein such individual magnets are arranged with alternating poles adjacent one another. The reason for such an arrangement is because an array of magnets placed in repelling positions are extremely powerful and much more effective and economical than a single multi-pole magnet.

Figure 4:
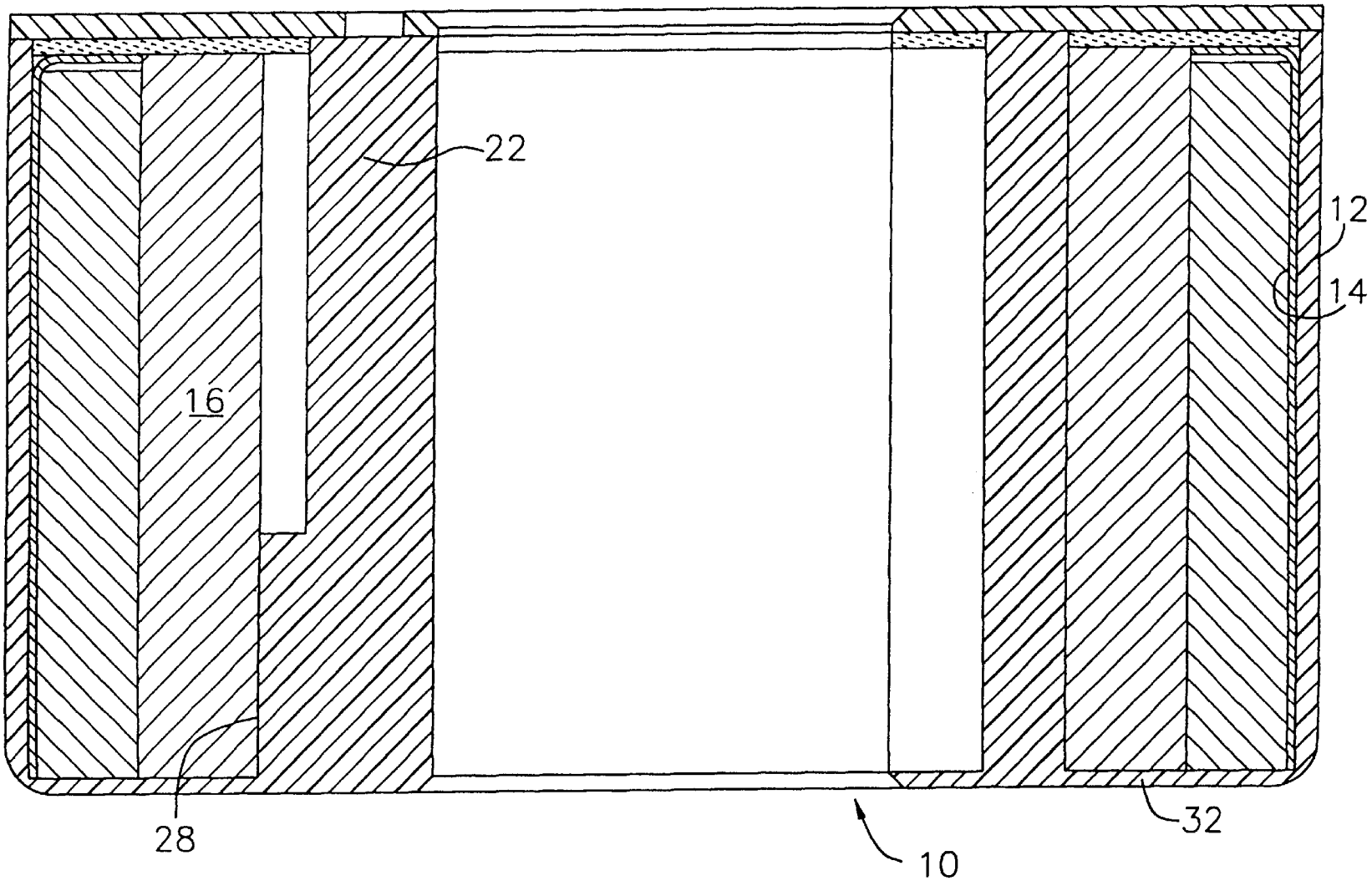
FIG. 4 illustrates a transverse cross-section of a completely assembled encapsulated magnet assembly of FIG. 3 across section 4—4.

FIG. 4 illustrates the example magnet assembly from another cross-sectional perspective, that more clearly shows the cooperation between the magnet 16 and the inside structure 22. Specifically, the projection 28 is positioned near a bottom portion of the battery chamber 14 adjacent the base 32 of the housing 12, and extends axially therefrom a limited distance toward the top portion of the housing, i.e., the projections do not extend axially the complete distance between the housing base and housing top. The reasons for this is to reduce the amount of material used to form the housing, thereby providing a housing that is both economically efficient to make and that is lighter in weight. The complementary battery groves 30 can extend along the entire axial distance of the battery inside diameter or only a partial distance to facilitate engagement with the projections.

Encapsulated magnet assemblies of this invention are assembled by first loading the magnet into the housing magnet chamber so that the projections engage the magnet grooves to fix the magnet rotationally therein. The protective spacer is positioned over the exposed axial surface of the magnet within the annular magnet chamber opening, and the end cap is positioned over the top of the protective spacer and is aligned within the annular magnet chamber opening for attachment. The end cap is then permanently attached to the housing by heat fusing or fuse bonding method that is conventionally used for permanently fixing two polymer components together to form an air and liquid-tight seal to encapsulate the magnet therein. A key feature of this invention is the use of the protective spacer minimizes or eliminates the transmission of unwanted thermal energy to the magnet during this process, thereby reducing or eliminating the potential for thermal-induced magnetic losses.

Another key feature of this invention is the complementary configuration of the housing and magnet that are designed to fix the magnet rotatably within the housing to prevent decoupling. Although a tongue and groove-type housing and magnet arrangement has been disclosed and illustrated, it is to be understood that other complementary types of mechanical arrangements can be used within the scope of this invention to achieve the same result. The use of such fixing arrangement between the housing and magnet is important in applications where the assembly is used as a rotating element, e.g., a pump impeller, that is urged into rotational movement by the magnetic force of the magnet within the housing. Any decoupling between the magnet and housing in such application would render the assembly at best inefficient, and at worst unusable.

Accordingly, it is to be understood that, within the scope of the appended claims, encapsulated magnet assemblies constructed according to principles of this invention may be embodied other than as specifically described herein.

What is claimed is:

1. An encapsulated magnet assembly comprising:

a magnet housing formed from a non-metallic material having an annular chamber disposed therein, wherein the chamber includes an opening at one housing end for receiving a magnet;

an annular magnet disposed within the chamber, the magnet including two axial ends, wherein one of the magnet axial ends exposed is positioned adjacent the chamber opening;

an annular cap formed from a non-metallic material and disposed over the magnet axial end and the chamber opening, wherein the cap is permanently attached to the one housing end defining the chamber opening to form an air and liquid-tight seal therewith to completely encapsulate the magnet within the housing; and an insulator interposed between the magnet axial end and the cap, the insulator being formed from a thermally insulating material.

2. The magnet assembly as recited in claim 1 wherein the housing further comprises means disposed within the chamber for engaging the magnet to prevent rotational movement of the magnet within the chamber.

3. The magnet assembly as recited in claim 2 wherein the means comprises one or more projections that extend from adjacent surfaces of one of the chamber or the magnet and that are disposed within one or more complementary receptacles in the other of the chamber or the magnet.

4. The magnet assembly as recited in claim 3 wherein the means comprise one or more projections projecting radially within the chamber.

5. The magnet assembly as recited in claim 1 wherein the insulator is made from a material that is heat resistant above a minimum temperature of 500° F.

6. The magnet assembly as recited in claim 5 wherein the material is mica.

7. The magnet assembly as recited in claim 1 wherein the housing and cap are each formed from a fluoropolymeric material.

8. An encapsulated magnet assembly comprising:

a ring-shaped magnet housing formed from a non-metallic material having an annular chamber disposed therein, wherein the chamber includes an annular opening at one housing end for receiving a magnet;

an annular magnet disposed within the chamber and having opposed axial ends, wherein one of the axial ends is positioned adjacent the chamber opening;

an annular cap formed from a non-metallic material and disposed over the chamber opening, wherein the cap is permanently attached to the housing annular opening to form an air and liquid-tight seal therewith to completely encapsulate the magnet within the housing;

a ring-shaped spacer interposed between the magnet axial end and the cap formed from a thermally insulating material; and means for preventing rotation of the magnet within the chamber.

9. The magnet assembly as recited in claim 8 wherein the means for preventing rotation of the magnet comprises a tongue and groove cooperative arrangement between the housing and magnet.

10. The magnet assembly as recited in claim 9 wherein the housing includes one or more tongues that extend radially into the magnet chamber, and the magnet includes one or more complementary grooves to accommodate respective tongues therein.

11. The magnet assembly as recited in claim 8 wherein the housing and cap are formed from fluoropolymer materials selected from the group consisting of polytetrafluoroethylene, fluorinated ethylene-propylene, perfluoroalkoxy fluorocarbon resin, polychlorotrifluoroethylene, ethylene-chlorotrifluoroethylene copolymer, ethylene-tetrafluoroethylene copolymer, polyvinylidene fluoride, polyvinyl fluoride, and combinations thereof.

12. An encapsulated magnet assembly comprising:

a ring-shaped magnet housing formed from a non-metallic material having an annular chamber disposed therein, wherein the chamber includes an opening at one housing end and includes one or more projections that extend radially into the chamber;

a ring-shaped magnet disposed within the chamber, the magnet including one or more grooves disposed along an inside or outside diameter surface to accommodate and cooperate with respective projections to prevent the magnet from rotating within the chamber, the magnet having an axial end that is positioned next to the one housing end;

a cap formed from a non-metallic material and disposed over the chamber opening, wherein the cap is permanently attached to the one housing end to form an air and liquid-tight seal therewith to completely encapsulate the magnet within the housing; and a ring-shaped spacer interposed between the magnet end and the cap within the chamber opening formed from a thermally insulating material.

13. The magnet assembly as recited in claim 12 wherein the spacer is made from a material that is heat resistant above a minimum temperature of 500° F.

14. The magnet assembly as recited in claim 13 wherein the spacer is formed from mica.

15. The magnet assembly as recited in claim 12 wherein the housing and cap are formed from fluoropolymer materials selected from the group consisting of polytetrafluoroethylene, fluorinated ethylene-propylene, perfluoroalkoxy fluorocarbon resin, polychlorotrifluoroethylene, ethylene-chlorotrifluoroethylene copolymer, ethylene-tetrafluoroethylene copolymer, polyvinylidene fluoride, polyvinyl fluoride, and combinations thereof.

16. An encapsulated magnet assembly comprising:

a magnet housing formed from a non-metallic material having an annular chamber disposed therein, wherein the chamber includes an opening at one housing end for receiving a magnet;

an annular magnet disposed within the chamber, the magnet including two axial ends, wherein one of the magnet axial ends is positioned adjacent the chamber opening;

an annular cap formed from a non-metallic material and disposed over the magnet axial end and the chamber opening, wherein the cap is permanently attached to the one housing end defining the chamber opening to form an air and liquid-tight seal therewith to completely encapsulate the magnet within the housing;

an insulator interposed between the magnet axial end and the cap, the insulator being formed from a thermally insulating material; and one or more projections that extend from adjacent surfaces of one of the chamber or the magnet and that are disposed within one or more complementary receptacles in the other of the chamber or the magnet.

17. An encapsulated magnet assembly comprising:

a ring-shaped magnet housing formed from a non-metallic material having an annular chamber disposed therein, wherein the chamber includes an annular opening at one housing end for receiving a magnet;

an annular magnet disposed within the chamber and having opposed axial ends, wherein one of the axial ends is positioned adjacent the chamber opening;

an annular cap formed from a non-metallic material and disposed over the chamber opening, wherein the cap is permanently attached to the housing annular opening to form an air and liquid-tight seal therewith to completely encapsulate the magnet within the housing; and a ring-shaped spacer interposed between the magnet axial end and the cap formed from a thermally insulating material;

wherein the chamber and magnet comprise a tongue and groove cooperative arrangement for preventing unwanted rotation of the magnet within the housing.

* * * * *

UNITED STATES PATENT AND TRADEMARK OFFICE

CERTIFICATE OF CORRECTION

PATENT NO. : 6,380,833 B1 
DATED : April 30, 2002
INVENTOR(S) : Hy Ba Nguyen, Mario Fregoso and Thomas J. Sievers It is certified that error appears in the above-identified patent and that said Letters Patent is hereby corrected as shown below:

Column 6,
Line 28, before "is positioned" delete "exposed".

Signed and Sealed this

First Day of April, 2003

JAMES E. ROGAN
*Director of the United States Patent and Trademark Office*